United States Patent [19]

Bravo

[11] 4,345,617

[45] Aug. 24, 1982

[54] LOCK APPARATUS FOR STORAGE TANKS

[76] Inventor: Sergio M. Bravo, 1823 N. Hill Dr., South Pasadena, Calif. 91030

[21] Appl. No.: 129,509

[22] Filed: Mar. 11, 1980

[51] Int. Cl.[3] ..... B65D 39/16; B65D 55/12; B65D 55/14; F16K 35/00

[52] U.S. Cl. ..... 137/385; 70/177; 70/180; 70/212; 70/DIG. 58; 137/588; 220/86 AT

[58] Field of Search ..... 141/301, 348, 349; 220/86 AT, 210, 85 P, 86 R, 256, 259, 263; 251/98, 95, 214, 305, 308; 137/385, 382, 384, 377, 383, 613, 588, 594–595; 70/180, 179, 176, 177, 54, 56, 212, 417, 416, DIG. 58

[56] References Cited

U.S. PATENT DOCUMENTS

| | | | |
|---|---|---|---|
| 1,099,077 | 6/1914 | Wray | 70/180 |
| 1,171,706 | 2/1916 | Crabtree | 137/613 X |
| 1,422,336 | 7/1922 | Cathrill | 70/180 |
| 1,738,069 | 12/1929 | Holtson | 137/613 X |
| 1,882,154 | 10/1932 | Mann et al. | 141/348 X |
| 2,064,967 | 12/1936 | Young | 141/349 |
| 2,399,578 | 4/1946 | Smith | 137/382 |
| 2,802,492 | 8/1957 | Gosselin | 141/348 X |
| 3,296,680 | 1/1967 | Fritz | 251/305 X |
| 3,338,611 | 8/1967 | Bertovich, Jr. et al. | 70/212 X |
| 3,990,182 | 11/1976 | Linder | 70/56 X |

FOREIGN PATENT DOCUMENTS

| | | | |
|---|---|---|---|
| 553759 | 5/1923 | France | 137/613 |
| 646259 | 11/1928 | France | 137/594 |
| 664985 | 9/1929 | France | 220/86 AT |
| 400146 | 10/1933 | United Kingdom | 220/263 |

*Primary Examiner*—Roy D. Frazier
*Assistant Examiner*—Carl F. Pietruszka
*Attorney, Agent, or Firm*—Nilsson, Robbins, Dalgarn, Berliner, Carson & Wurst

[57] ABSTRACT

A lock apparatus for attachment to the top of an input pipe communicating with a storage tank includes an open-ended cylindrical housing for mounting to the top of the input pipe, a butterfly valve mechanism pivotally mounted in the housing with a butterfly valve activating axle protruding through an orifice in the housing, and a locking mechanism. The locking mechanism includes a latch pivotally attached to the protruding end of the axle, a lock flange attached to the outside of the housing and, a tamper prevention flange in linear alignment with the axle and the latch to prevent unauthorized tampering with the axle and attached latch. The latch may be coupled to the lock flange and locked to maintain the butterfly valve in the closed position across the interior of the housing.

12 Claims, 4 Drawing Figures

LOCK APPARATUS FOR STORAGE TANKS

BACKGROUND OF THE INVENTION

The present invention relates to a lock apparatus and in particular to a lock apparatus mountable to a pipe communicating with a storage tank to prevent unauthorized withdrawals from the storage tank.

With the advent of increasing gasoline prices, a serious problem of theft has arisen whereby individuals insert a hose into a storage tank at a gasoline station through the fuel input pipe communicating with an underground storage tank. The fuel can then be easily pumped from the underground storage tank thereby effecting a theft of the fuel.

Various devices have been devised to prevent such unauthorized withdrawals. However, these devices have generally been in the form of a lock-on cap mechanism which is inserted over the top of the communicating pipe. For example, one such cap mechanism incorporates a lock flange which extends upwardly from the top surface of the cap and a latch which is pivotally mounted to the side of the cap. The latch is then pivotal between a locked and an unlocked position with the lock flange being positioned in such a way that when the latch is pivoted to the locked position a padlock can be inserted into a hole in the lock flange to prevent pivotal movement of the latch to the unlocked position.

Although this and other similar cap type lock devices prevent access to the underground storage tank through the pipe, it has been found that such caps can be easily removed by exerting pressure with a crowbar or the like against either the latch or the lock flange to break either the latch or the lock flange. Consequently, there is a need for a more secure locking mechanism to prevent thefts of gasoline or other flowable substances from storage tanks.

The present invention provides such an improved lock mechanism by providing an open ended cylindrical housing for attachment to the top of the input pipe. The cylindrical housing includes a radially mounted butterfly valve mechanism which is pivotal in the interior of the housing between an opened and a closed position. The butterfly valve mechanism includes an axle which has one end extending through an orifice in the side of the cylindrical housing. A latch is then pivotally attached to the protruding end of the axle with a lock flange being affixed to the outside surface of the housing whereby the latch and the lock flange are aligned for interconnecting to one another when the butterfly valve is in the closed position. A suitable padlock or other locking device can then be attached to the lock flange to maintain the coupled relationship of the lock flange and the latch. A suitable tamper prevention flange is then provided to extend outwardly from the housing immediately above the protruding end of the axle.

The tamper prevention flange is positioned to protect the axle and latch and prevent the insertion of a prying device to effect a breaking of the latch or axle.

SUMMARY OF THE INVENTION

A lock apparatus for attachment to the top of a pipe communicating with a storage tank for preventing insertion of into the storage tank through the pipe, comprising a cylindrical housing having a top part, and a bottom part for attachment to the pipe, and a radial orifice through the side of the cylindrical housing at a central location between the top and bottom parts. A butterfly valve plate is attached to an axle, the combination being pivotal in the interior of the cylindrical housing between a closed and an opened position. The axle extends through the radial orifice so that when the axle is pivoted the butterfly valve is pivoted. A latch member is then pivotally attached to the end of the axle protruding through the radial orifice of the cylindrical housing with the latch member having a latch orifice therethrough. A lock flange is fixed to the external surface of the housing between the radial orifice and the bottom part of the housing with the latch member being selectively positioned over the lock flange so that the lock flange extends through the latch orifice when the butterfly valve is in the closed position to thereby couple the latch member and the lock flange together. Means, such as a padlock, are provided for selectively locking the latch member and the lock flange in coupled relationship. A tamper-prevention flange is fixed to extend radially from the external surface of the cylindrical housing adjacent the top part above the radial orifice and in linear alignment with the radial orifice and the lock flange.

In one embodiment of the invention, the lock apparatus may also provide a positioning flange fixed to and extending from the surface of the cylindrical housing whereby the latch member and the positioning flange may be interconnected together when the axle is pivoted to position the butterfly valve in the opened position. The butterfly valve can thus be maintained in the open position when, for example, fuel is being inserted into the storage tank.

In the preferred embodiment an "O" ring or other seal device may be inserted between the axle and the housing in the radial orifice for preventing fluid leakage through the radial orifice.

In another embodiment, the present invention includes an open ended cylindrical housing having an axial cavity along a central axis for attachment to the top of the pipe, and a radial orifice through the side of the cylindrical housing. A cylindrical tube is provided to extend through the axial cavity for radially bifurcating the axial cavity to define a central passageway in the interior of the cylindrical tube and a circumferential passageway between the outside surface of the cylindrical tube and the inside surface of the cylindrical housing whereby the cylindrical tube is axially moveable in the axial cavity. An axle is provided to extend through the radial orifice in the cylindrical housing and a first slot orifice of the cylindrical tube A butterfly plate, fixed to the axle, is positioned for being pivoted between an open and closed position in the central passageway of the cylindrical tube. A first seal means is provided between the axle and the cylindrical tube for preventing leakage through the first slot orifice and a second seal means is provided between the axle and the cylindrical housing for preventing leakage through the radial orifice. As in the prior embodiment, a latch member, a lock flange and a tamper-prevention flange are provided outside of the cylindrical housing.

In one embodiment the first seal means may comprise a first plate having a first plate orifice therethrough positioned in the circumferential passageway and a second plate having a second plate orifice therethrough positioned in the central passageway whereby the first and second plates have a shape and size for being positioned to oppose each other for covering the first slot orifice. At least one resilient seal member with a seal orifice therethrough is then positioned between the first and second plates to cover the slot. The axle thus extends through the first and second plate orifices and the seal orifice. Finally, means are provided for pressing the first and second plates against the cylindrical tube for holding the seal member in covering relationship over the first slot orifice for preventing leakage through the first slot orifice.

The cylindrical tube may also have a second slot orifice which is opposite the first slot orifice with a third seal means between the axle and the cylindrical tube for preventing fluid passage through the second slot orifice. The third seal means may have a structure similar to the first seal means including appropriate plates, resilient seal member and means for pressing the two plates against the cylindrical tube for holding the seal member to cover the second slot orifice to thereby prevent leakage through the second slot orifice.

BRIEF DESCRIPTION OF THE DRAWINGS

A complete understanding of the present invention and of the above and other objects and advantages thereof may be gained from a consideration of the following description of the preferred embodiments taken in conjunction with the accompanying drawings in which.

DETAILED DESCRIPTION

Figure 1:
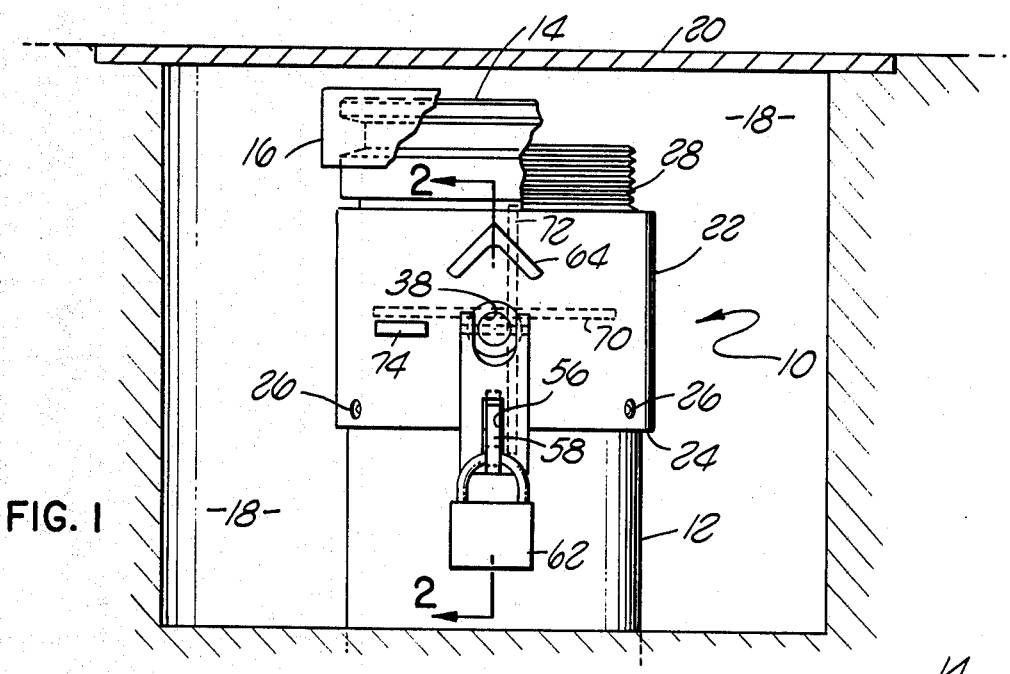
FIG. 1 is a side plan view of a lock apparatus in accordance with the invention in position on top of pipe communicating with a storage tank.

Referring first to FIG. 1, the present invention comprises a lock apparatus 10 which is fixed by appropriate means such as an inside thread, to the top of a pipe 12 having an outside thread. The pipe communicates with for example an underground storage tank (not shown). An appropriate adapter member 14 may then be fixed, such as by a threaded interconnection, to the top of the lock apparatus 10 with a suitable cap 16 being removably positioned on top of the adapter member 14. The entire assembly including the lock apparatus 10, the adapter 14 and the cap 16 are positioned underground in a ground cavity 18 which may be enclosed by a cover plate 20.

When it is desired to insert a fluid into the underground storage tank through the pipe 12, the cover plate 20 and then the cap 16 are removed. A hose with an appropriate nozzle interconnection arrangement is then attached and held by the adapter member 14. The lock apparatus 10 is then opened and the fluid, such as gasoline or the like, is pumped from a tank truck, for example, to the underground storage tank.

Figure 2:
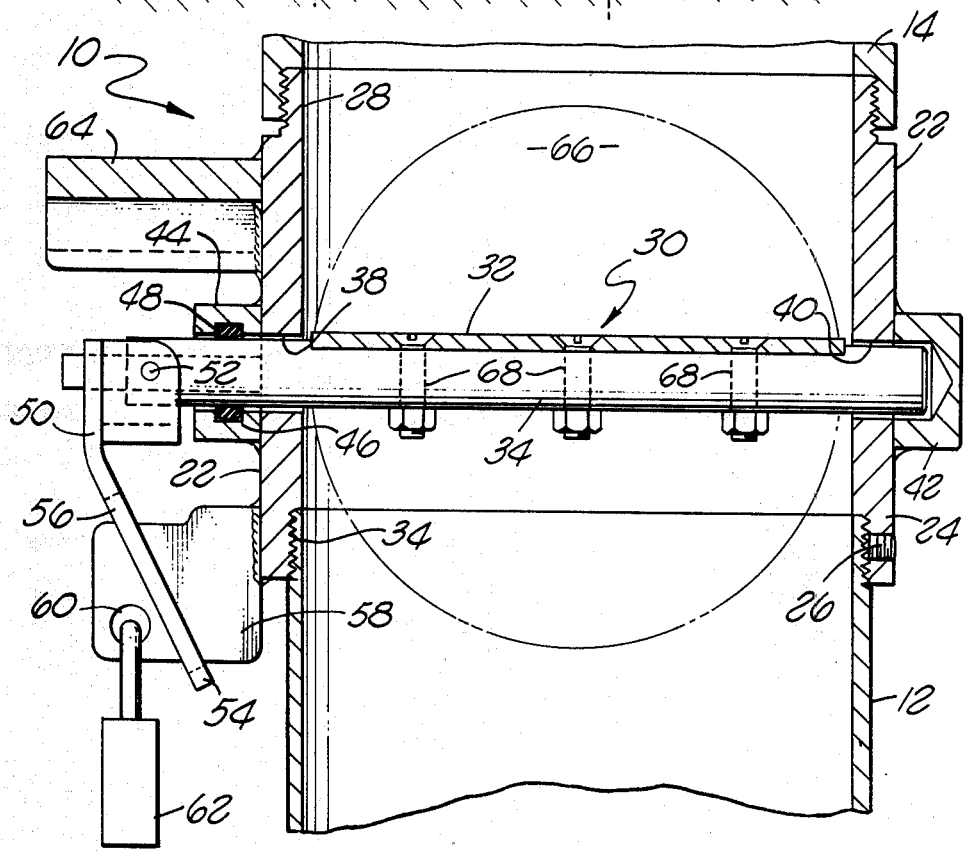
FIG. 2 is a side cross-sectional plan view of the lock apparatus in accordance with the invention.

Referring now more specifically to FIG. 1 in connection with FIG. 2, the lock apparatus 10 in accordance with the invention includes a cylindrical housing 22 having a bottom part 24 which is attached to the top of the pipe 12. In one embodiment, the bottom part 24 of the housing 22 may have an interior thread which is screwed onto the top of an exterior thread on the top of the pipe 12. A plurality of set screws 26 may be provided to immovably interconnect the lock apparatus 10 to the top of the pipe 12 to prevent the lock apparatus 10 from being simply unscrewed from the top of the pipe 12.

The lock apparatus 10 also has a top part 28 which preferably has an external thread to which the adapter 14, having an internal thread, can be attached by simply screwing the adapter 14 onto the top part 28 of the lock apparatus 10.

A butterfly valve apparatus 30 is then pivotally attached in the interior of the lock apparatus 10. The butterfly valve apparatus comprises a plate 32 attached to an axle 34 by screws or other suitable means 68. The axle 34 and plate 32 are pivotally attached to extend through the radial orifice 38 in the side of the cylindrical housing 22. The axle 34 may be supported by the housing 22 entirely at the orifice 38. Alternatively, the axle 32 may be pivotally interconnected across a diameter of the cylindrical housing 22 between an orifice 40 on one side and the orifice 38 on the opposite side. A cap member 42 may then be provided on the outside of the cylindrical housing 22 to cover and seal the orifice 40.

A cylindrical flange 44 may be attached by welding or the like to the outside of the housing 22 surrounding the orifice 38. The cylindrical flange 44 may be provided with a cylindrical seal retaining groove 46 disposed about the interior cylindrical surface of the cylindrical flange 44. A suitable radial orifice seal such as an "O" ring seal 48 may be disposed in the seal retention groove 46 around the axle 34 to prevent fluid entering the storage tank through the cylindrical housing 22 from leaking out through the orifice 38. Of course it will be appreciated that leakage through the orifice 40 is prevented because the cap 42 seals that orifice without the need for seals.

In summary, therefore, the axle 34 is mounted to the cylindrical housing 22 by providing one end of the axle to extend into the orifice 40 to be supported by the cylindrical housing 22 and to extend through the orifice 38 and the cylindrical flange 44 opposite the orifice 40.

A latch member 50 is pivotally attached by a pin 52 to the end of the axle 34 extending through the orifice 38 and the cylindrical flange 44. The latch member 50 is provided with a downwardly extending inwardly bent flange portion 54 having a latch orifice 56 disposed therethrough. In the preferred embodiment the latch 56 is a slot along the length of the downwardly extending flange portion 52 of the latch member 50.

A lock flange 58 is disposed by welding or the like to extend from the cylindrical housing 22. The lock flange 58 is positioned vertically below the orifice 38 and is welded to extend from the bottom part 34 of the cylindrical housing 22. The lock flange 58 is provided with an orifice 60 therethrough for receiving a padlock 62.

Finally, a tamper prevention flange 64 is attached by welding or the like to extend from the external surface of the cylindrical housing 22 adjacent the top part 28 thereof. The tamper prevention flange 64 is also preferably disposed in vertical alignment with the cylindrical flange 44 and the lock flange 58 and is of a sufficient length to prevent a tool such as a crowbar or the like from being inserted against the end of the axle 34 thereby preventing any possibility that the latch member 50 could be pried or broken off of the end of the axle 34.

In operation, the butterfly valve apparatus 30 is pivotal between a closed position and an open position. The butterfly plate 32 is preferably the same shape as the interior cross-section of the axial cavity 66 through the cylindrical housing 22 in order to prevent the unauthorized insertion of a tube, hose or other object into the fuel storage tank through the pipe 12. Thus, if the axial cavity 66 is circular, then the butterfly valve plate 32 will also be circular but will, of course, be of a slightly smaller diameter to allow pivotal rotation of the plate in the interior of the axial cavity 66 without coming in contact with the sides of the cylindrical housing 22. The butterfly plate 32 is attached to the axle at a location selected so that the butterfly plate 32 extends across the axial cavity 66 in the closed position when the latch orifice 56 of the latch member 50 is aligned with the lock flange 58. Thus, when the lock flange 58 extends through the latch orifice 56, the plate 32 will be in the closed position preventing any object from being inserted through the axial cavity 66 into the underground storage tank.

When it is desired to open the butterfly valve apparatus 30, the latch member 50 is merely rotated outwardly about the pin 52 to disconnect the latch member 50 from the lock flange 58. The latch member 50 may then be rotated 90 degrees so that the plate is in a vertical, opened position rather than the previously discussed horizontal closed position.

A positioning flange 74 may also be provided to extend from the side of the cylindrical housing 22 at a location disposed at an angle approximately 90 degrees from the lock flange 58 about the axle 34, to maintain the plate 32 in a vertical, opened position, to allow fluid to be inserted through the pipe 12 into the storage tank.

Figure 3:
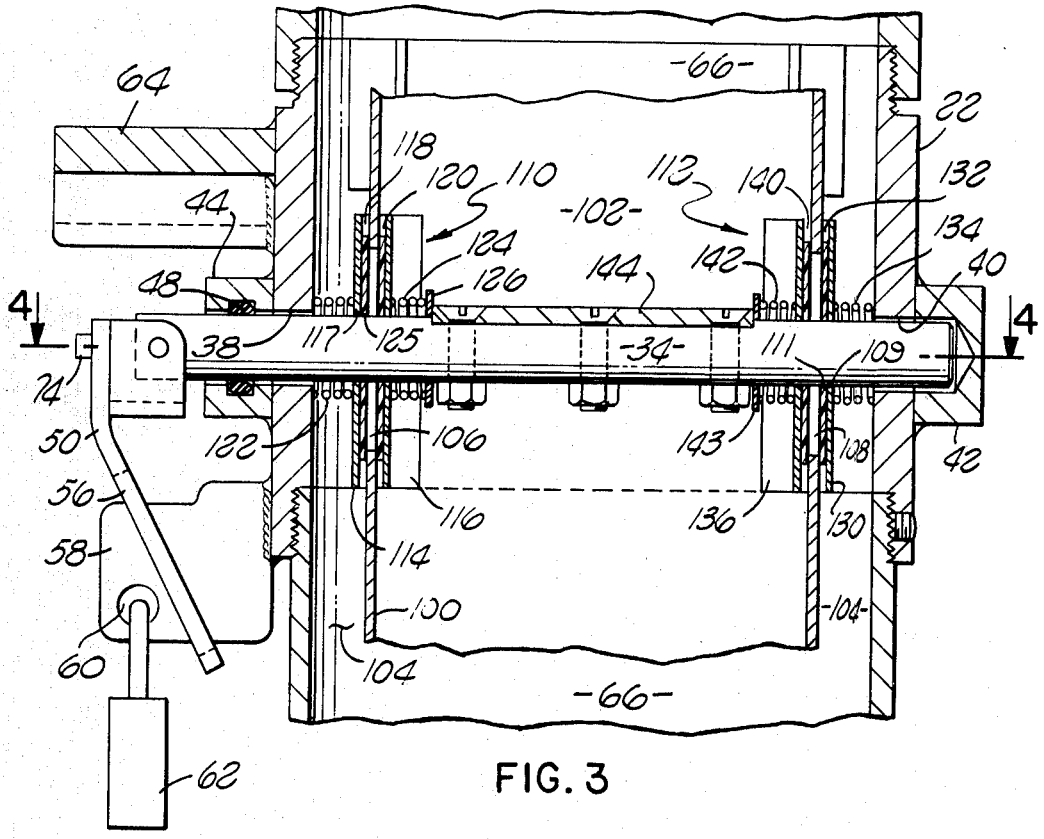
FIG. 3 is a side cross-sectional plan view of a second embodiment of a lock apparatus in accordance with the invention.
Figure 4:
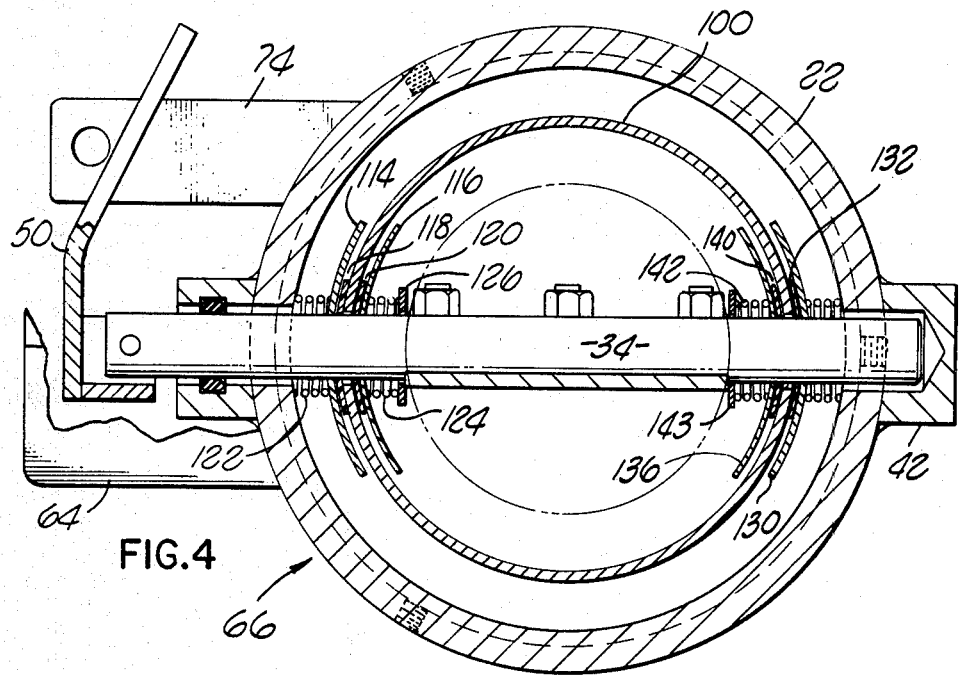
FIG. 4 is a top cross-sectional plan view of the second embodiment illustrated in FIG. 3.

Referring now to FIGS. 3 and 4, a second embodiment of the present invention is illustrated wherein a cylindrical tube 100 is centrally disposed to extend through the central housing 22 thus bifurcating the axial cavity 66 into a central passageway 102 extending through the cylindrical tube and a circumferential passageway 104 extending downwardly through the cylindrical housing 22 between the cylindrical tube 100 and the cylindrical housing 22.

The purpose of this bifurcated axial cavity arrangement is to provide a means of vapor recovery without the need for having two pipes interconnected to the storage tank. Thus, the gasoline or other fluid is inserted into the storage tank through the central passageway 102 and the fumes, which must necessarily be displaced, pass out through the circumferential passageway 104 surrounding the central passageway 102. Such an arrangement is well known in accordance with one type of vapor recovery system.

In order to provide a lock apparatus in accordance with the invention in this arrangement, it is necessary that the axle extend not only through the orifice 38 in the housing 22, but also extend through orifices in the cylindrical tube 100. Furthermore, in most arrangements in which a cylindrical tube 100 is incorporated, the cylindrical tube 100 is provided to move upwardly and downwardly to a small extent, thus requiring that the cylindrical tube 100 include at least one slot orifice in one side and aligned with the radial orifice 38 in the housing. More specifically, the cylindrical tube 100 includes a first slot orifice 106 and optionally includes a second slot orifice 108 located radially opposite to the first slot orifice 106. The width of the slot orifices 106 and 108 are approximately the same as the width of the axle 34.

A first seal apparatus 110 is then disposed around the axle 34 to cover the first slot orifice 106 so that fluid passing through the central passageway 102 does not leak through the first slot orifice and into the circumferential passageway 104. Similarly, a second seal apparatus 112 is disposed about the axle 34 to cover the second slot orifice 108 to likewise prevent the passage of fluid from the central passageway 102 through the second slot orifice 108 into the circumferential passageway 104.

The seal apparatus 110 may comprise a first semicircular cross-sectioned plate 114 having a cylindrical axle-receiving orifice 117 therethrough, positioned adjacent the outside of the cylindrical tube 100 covering the first slot orifice 106. A second plate is simiarly disposed adjacent the inside surface of the cylindrical tube 100 also covering the first slot orifice 106. A first resilient seal member 118, having an axle receiving orifice 125 therethrough and which may be made out of rubber or any other suitable sealing material, is disposed between the first plate 114 and the outside surface of the cylindrical tube 100 and a second resilient seal member 120 is positioned between the second plate 116 and the inside surface of the cylindrical tube 100 to also cover the first slot orifice 106. A spring 122 or other suitable pressing means is disposed between the inside wall of the cylindrical housing 22 and the first plate 114 to press the first plate 114 against the cylindrical tube 100 with the seal 118 compressed therebetween.

A second spring 124 is likewise disposed between a suitable washer-like flange 126 which is fixed to the axle 34 so that the spring 124 exerts a force against the second plate 116 to thereby press the plate 116 against the cylindrical tube 100 with the seal 120 compressed therebetween.

Of course, it will be appreciated that while two plates and two seals are preferred, a single plate and seal may be sufficient to provide adequate sealing in many instances and hence the second plate and second seal may be eliminated.

In a similar manner the second seal apparatus 112 consists of a third plate 130 being an axle receiving orifice 108, and a third resilient seal member 132, also having an axle receiving orifice 111 therethrough, which are disposed to cover the second slot orifice 108. A spring 134 is disposed to press against the plate 130 and thereby hold the seal 132 in place against the cylindrical tube 100 to cover the slot 108.

A fourth plate 136 may also be disposed adjacent the inside surface of the cylindrical tube 100 with a resilient seal member 140 disposed between the plate 136 and the inside surface of the cylindrical tube 100. A suitable spring 142 may then be positioned between a circumferential washer-like flange 143 which is attached about the periphery of the axle 34. The spring thus presses the plate 136 and hence the seal 140 against the inside of the cylindrical tube 100 covering the slot 108 to thereby prevent fluid from passing from the central passageway 102 to the circumferential passageway 104.

In accordance with the invention, a butterfly plate 144 is attached to a flattened region of the axle 34 to extend substantially across the interior of the cylindrical tube 100 to thereby close the central passageway 102 and prevent the insertion of an object through the central passageway 102 into the storage tank.

While specific embodiments of the invention have been described, it will be appreciated that various other arrangements are possible. For example, the axle 34 may be supported entirely by the cylindrical flange and central housing 22 at the first orifice 38 without the need for a orifice 40 or a cap 42. Similarly, the second slot 108 may be eliminated if the axle 34 is provided to terminate at a central location in the cylindrical tube 100. Finally, it will be appreciated that the present invention may be made in various sizes and the flanges may have various shapes without departing from the spirit of the invention.

While the present invention has been particularly shown and described with reference to the preferred embodiments, it will be understood by those skilled in the art that the foregoing and other changes in form and detail may be made without departing from the spirit of the invention.

What is claimed is:

1. A lock apparatus for attachment to a pipe communicating with a storage tank for a flowable substance for preventing insertion of a foreign object into the storage tank through the pipe, comprising:

a cylindrical housing having a top part, a bottom part for attachment to the pipe, and a transverse orifice through the side of the cylindrical housing;

a plate pivotal in the interior of the cylindrical housing between a closed position and an open position;

an axle fixed to the plate and extending through the transverse orifice, the axle being pivotal in the transverse orifice to pivot the plate;

a latch member pivotally attached to the axle externally of the cylindrical housing, the latch member having a latch orifice therethrough;

a lock flange fixed to the external surface of the cylindrical housing between the radial orifice and the bottom part, the latch member being selectively positioned over the lock flange with the lock flange extending through the latch orifice when the plate is in the closed position to thereby couple the latch member to the lock flange; and a tamper prevention flange fixed to extend radially from the external surface of the cylindrical housing in linear alignment with the transverse orifice and the lock flange.

2. The lock apparatus of claim 1 further comprising a positioning flange fixed to and extending from the surface of the cylindrical housing, the latch member being pivotal into a position with the positioning flange extending through the latch orifice for coupling the latch member to the positioning flange, the positioning flange being fixed to the cylindrical housing at a location for maintaining the plate in an open position when the latch member is coupled to the positioning flange.

3. The lock apparatus of claims 1 or 2 wherein the axle is pivotally interconnected to the cylindrical housing between the transverse orifice and a location of the cylindrical housing radially opposite the radial orifice.

4. The lock apparatus of claims 1 or 2 further comprising a radial orifice seal member positioned around the axle in the radial orifice for preventing leakage through the radial orifice.

5. A lock apparatus for attachment to a pipe communicating with a storage tank for a flowable substance for preventing insertion of a foreign object into the storage tank through the pipe, comprising:

an open-ended, cylindrical housing for attachment to the top of the pipe, the cylindrical housing having an axial cavity along its central axis and a radial orifice through the side of the cylindrical housing;

a cylindrical tube extending through the axial cavity for radially bifurcating the axial cavity to define a central passageway in the interior of the cylindrical tube and a circumferential passageway between the outside surface of the cylindrical tube and the inside surface of the cylindrical housing, the cylindrical tube being axially movable in the axial cavity and having a first slot orifice therethrough;

an axle extending through the radial orifice and the first slot orifice;

a valve plate fixed to the axle and positioned in the central passageway for pivoting with the axle between a closed position and an open position;

first seal means positioned around the axle and adjacent the cylindrical tube for preventing leakage through the first slot orifice;

second seal means positioned between the axle and the cylindrical housing for preventing leakage through the radial orifice;

a latch member pivotally attached to the end of the axle external to the cylindrical housing, the latch member having a latch orifice therethrough;

a lock flange fixed to the external surface of the cylindrical housing, the latch member being selectively positioned over the lock flange with the lock flange extending through the latch orifice when the valve plate is in the closed position for coupling the latch member to the lock flange; and a tamper-prevention flange fixed to extend radially from the external surface of the cylindrical housing in linear alignment with the radial orifice and the lock flange.

6. The lock apparatus of claim 5 wherein the first seal means comprises:

a first plate having a first plate orifice therethrough positioned in the circumferential passageway;

a second plate having a second plate orifice therethrough positioned in the central passageway, the first and second plates having a shape and size and being positioned for opposing each other on opposite sides of the cylindrical tube for covering the first slot orifice;

at least one first resilient seal member with a first axle receiving orifice therethrough positioned between the first and second plates covering the first slot orifice whereby the axle extends through the first and second plate orifices and the first axle receiving orifice; and means for pressing the first and second plates against the cylindrical tube for holding the first seal member in covering relationship with the first slot orifice for preventing leakage through the first slot orifice.

7. The lock apparatus of claim 5 or 6 further comprising a positioning flange fixed to and extending from the surface of the cylindrical housing, the latch member being pivotal into a position with the positioning flange extending through the latch orifice for coupling the latch member to the positioning flange, the positioning flange being attached at a location for maintaining the valve plate in an open position when the latch member is coupled to the positioning flange.

8. The lock apparatus of claims 5 or 6 wherein the cylindrical tube has a second slot orifice aligned opposite the first slot orifice whereby the axle extends through the first and second slot orifices for being pivotally interconnected to the cylindrical housing opposite the radial orifice, the lock apparatus further comprising:

a third seal means positioned around the axle and adjacent the cylindrical tube for preventing leakage through the second slot orifice.

9. The lock apparatus of claim 8 further comprising a positioning flange fixed to and extending from the surface of the cylindrical housing, the latch member being pivotal into a position with the positioning flange extending through the latch orifice for coupling the latch member to the positioning flange, the positioning flange being attached at a location for maintaining the valve plate in an open position when the latch member is coupled to the positioning flange.

10. The lock apparatus of claim 8 further comprising:

a third plate having a third plate orifice therethrough positioned in the circumferential passageway;

a fourth plate having a fourth plate orifice therethrough positioned in the central passageway, the third and fourth plates having a shape and size and being positioned for opposing each other on opposite sides of the cylindrical tube for covering the second slot orifice;

at least one second resilient seal member with a second axle receiving orifice therethrough positioned between the third and fourth plates covering the slot orifice whereby the axle extends through the second, third and fourth plate orifices and the second axle receiving orifice; and means for pressing the second, third and fourth plates against the cylindrical tube for holding the second seal member against the second slot orifice for preventing leakage through the second slot orifice.

11. The lock apparatus of claim 10 further comprising a positioning flange fixed to and extending from the surface of the cylindrical housing, the latch member being pivotal into a position with the positioning flange extending through the latch orifice for coupling the latch member to the positioning flange, the positioning flange being attached at a location for maintaining the valve plate in an open position when the latch member is coupled to the positioning flange.

12. The lock apparatus of claims 1 or 5 further comprising an enclosure means defining a chamber wherein the lock apparatus is positioned in the chamber.

* * * * *